US009217401B2

(12) United States Patent
Uchiyama

(10) Patent No.: US 9,217,401 B2
(45) Date of Patent: Dec. 22, 2015

(54) FUEL SUPPLY DEVICE FOR INTERNAL COMBUSTION ENGINE

(71) Applicants: SUZUKI MOTOR CORPORATION, Shizuoka-Ken (JP); Tatsushi Uchiyama, Shizuoka-Ken (JP)

(72) Inventor: Tatsushi Uchiyama, Shizuoka-Ken (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 430 days.

(21) Appl. No.: 13/745,255

(22) Filed: Jan. 18, 2013

(65) Prior Publication Data

US 2013/0186370 A1 Jul. 25, 2013

(30) Foreign Application Priority Data

Jan. 23, 2012 (JP) ..... 2012-011287

(51) Int. Cl.

| | |
|---|---|
| ***F02M 55/02*** | (2006.01) |
| ***F02M 35/10*** | (2006.01) |
| ***F02M 63/02*** | (2006.01) |
| ***F02M 51/00*** | (2006.01) |
| ***F02M 61/14*** | (2006.01) |
| ***F02M 69/04*** | (2006.01) |
| ***F02M 69/46*** | (2006.01) |
| *F02M 69/54* | (2006.01) |

(52) U.S. Cl.

CPC ... *F02M 35/10216* (2013.01); *F02M 35/10039* (2013.01); *F02M 51/005* (2013.01); *F02M 61/14* (2013.01); *F02M 63/0275* (2013.01); *F02M 69/043* (2013.01); *F02M 69/044* (2013.01); *F02M 69/462* (2013.01); *F02M 69/465* (2013.01); *F02M 69/54* (2013.01)

(58) Field of Classification Search

CPC F02M 69/465; F02M 39/00; F02M 35/10216
USPC ..... 123/445, 468, 469
See application file for complete search history.

(56) References Cited

U.S. PATENT DOCUMENTS

| | | | | |
|---|---|---|---|---|
| 5,603,302 | A * | 2/1997 | Minagawa et al. | 123/456 |
| 2006/0207564 | A1 * | 9/2006 | Kinose | 123/431 |
| 2006/0272618 | A1 * | 12/2006 | Iwahashi | 123/458 |
| 2007/0000478 | A1 * | 1/2007 | Sadakane et al. | 123/431 |

(Continued)

FOREIGN PATENT DOCUMENTS

| | | | |
|---|---|---|---|
| EP | 1 387 081 | A2 | 2/2004 |
| EP | 1 681 459 | A1 | 7/2006 |

(Continued)

OTHER PUBLICATIONS

European Search Report dated Apr. 13, 2013 for corresponding European Patent Application No. 13152141.1.

(Continued)

*Primary Examiner* — John Kwon
(74) *Attorney, Agent, or Firm* — Barnes & Thornburg LLP

(57) ABSTRACT

A fuel supply device for an internal combustion engine including a throttle valve and an airbox is provided with a main injector disposed at a downstream side of the throttle valve, an auxiliary injector disposed at an upstream side of the throttle valve and in the airbox, and a delivery pipe disposed inside the airbox and adopted to supply and distribute a fuel to the auxiliary injector. The delivery pipe has both ends which are supported on two side walls of the airbox.

8 Claims, 8 Drawing Sheets

(56) References Cited

U.S. PATENT DOCUMENTS

| | | | | |
|---|---|---|---|---|
| 2007/0017484 | A1* | 1/2007 | Kinose | 123/431 |
| 2010/0030449 | A1* | 2/2010 | Ikoma | 701/103 |
| 2013/0152900 | A1* | 6/2013 | Masubuchi | 123/445 |

FOREIGN PATENT DOCUMENTS

| | | | |
|---|---|---|---|
| JP | 2000-097131 | A | 4/2000 |
| JP | 2005-188386 | A | 7/2005 |
| JP | 2005188386 | A | 7/2005 |
| JP | 2008-151150 | A | 7/2008 |
| JP | 2009-103137 | A | 5/2009 |

OTHER PUBLICATIONS

Japanese Office Action dated Oct. 6, 2015.

* cited by examiner

FUEL SUPPLY DEVICE FOR INTERNAL COMBUSTION ENGINE

PRIORITY CLAIM

This patent application claims priority to Japanese Patent Application No. 2012-011287, filed 23 Jan. 2012, the disclosure of which is incorporated herein by reference in its entirety.

BACKGROUND OF THE INVENTION

1. Field of the Invention

The present invention relates to a fuel supply device for an internal combustion engine, in which injectors are disposed at a downstream side and an upstream side of a throttle valve, respectively.

2. Related Art

With respect to a 4-cycle engine provided in a motorcycle or the like, there is a fuel supply device or apparatus that uses two injectors per one cylinder.

A fuel supply device, for an internal combustion engine, that includes a main injector at the downstream side of a throttle valve provided to a throttle body and an auxiliary injector at the upstream side of the throttle valve so as to supply fuel to both of the injectors from a fuel supply piping, is known from, for example, Patent Document 1 (Japanese Patent Laid-Open Publication No. 2005-188386).

The disclosed technology provides a fuel supply device for an internal combustion engine including a header pipe branched from the fuel supply piping in an airbox, and a bracket used for attaching each header pipe and a support member of a support plate are provided in the airbox.

Furthermore, Patent Document 1 discloses an example, in which the fuel supply device for an internal combustion engine, where the fuel supply piping is located outside the airbox and a fuel supply piping for the auxiliary injector is arranged outside the airbox.

In an arrangement of the fuel supply device for an internal combustion engine described in Patent Document 1, when the auxiliary injector and the fuel supply piping are arranged inside the airbox, since a bracket for fixing the fuel piping (a header pipe) and support members for a support plate and the like are provided, there are many support structures in the airbox. Accordingly, there causes a case in which the flow of intake air is disturbed and a pressure drop is caused, making smooth air supply difficult, or the box capacity is reduced due to the many support structures in the airbox.

Furthermore, in the case of arranging the fuel supply piping for the auxiliary injector outside the airbox, there also causes a case in which, for example, since the box capacity is sacrificed or reduced due to the installation outside the airbox, the intake air is easily influenced by the pulsation, and when the amount of intake air is drastically increased, the flow of the intake air is disturbed and the response is delayed.

Furthermore, if the auxiliary injector and a support structure supporting the fuel supply piping (the header pipe), the inside of the airbox is complicated, resulting in the increase of weight. Even if the inside of the airbox is complicated, the structure does not contribute to the reinforcement of the airbox, and there causes a problem in which, for example, a pressure drop is caused due to the flow of intake air being disturbed or that intake air resistance is increased.

SUMMARY OF THE INVENTION

The present invention was conceived in consideration of the circumstance described above, and an object thereof is to provide a fuel supply device for an internal combustion engine which causes a delivery pipe to function as a reinforcing material for an airbox, simplifies the structure inside the airbox, makes the flow of intake air in the airbox smooth, and improves the engine performance.

Another object of the present invention is to provide a fuel supply device for an internal combustion engine which simplifies the structure inside an airbox without increasing the weight, reduces the intake air resistance without sacrificing the airbox capacity and the flow of the intake air within the airbox, and makes the flow of the intake air smooth to thereby reduce a pressure drop.

The above and other objects can be achieved according to the present invention by providing a fuel supply device for an internal combustion engine provided with a throttle valve and an airbox, including a main injector disposed at a downstream side of the throttle valve, an auxiliary injector disposed at an upstream side of the throttle valve and in the airbox, and a delivery pipe disposed inside the airbox and adopted to supply and distribute a fuel to the auxiliary injector, wherein the delivery pipe has both ends which are supported on side walls of the airbox.

According to the present invention of the character and structure mentioned above, the delivery pipe can function as an reinforcing material for the airbox, any pipe support member for supporting the delivery pipe become unnecessary in the airbox to thereby simplify the structure inside the airbox. In addition, the intake air pressure inside the airbox can be effectively reduced and a pressure drop can be also reduced. Furthermore, the intake air can be smoothly flowed in, and also, the engine performance can be improved.

The nature and further characteristic features of the present invention will be made more clearer from the following descriptions made with reference to the accompanying drawings.

DESCRIPTION OF THE PREFERRED EMBODIMENT

Hereinafter, an embodiment of the present invention will be described with reference to the appended drawings. It is further to be noted that terms "upper", "lower", "right", "left" and like terms indicating directions are used herein basically with reference to the illustration of the drawings.

The embodiment of the present invention is a fuel supply device for an internal combustion engine that is applied to a motorcycle or the like provided with a 4-cycle engine.

[Structure of Motorcycle]

Figure 1:
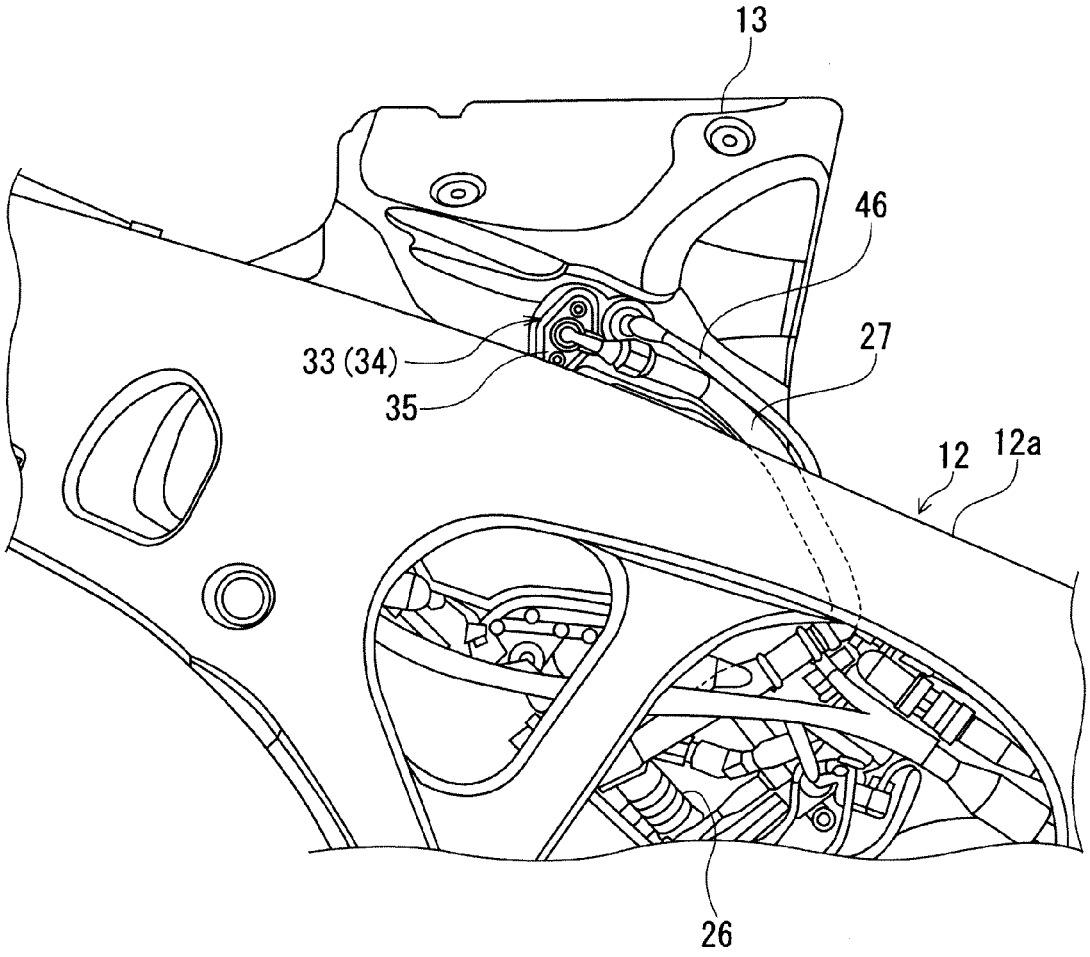
FIG. 1 is a left side view showing a vehicle upper front portion of a motorcycle.
Figure 2:
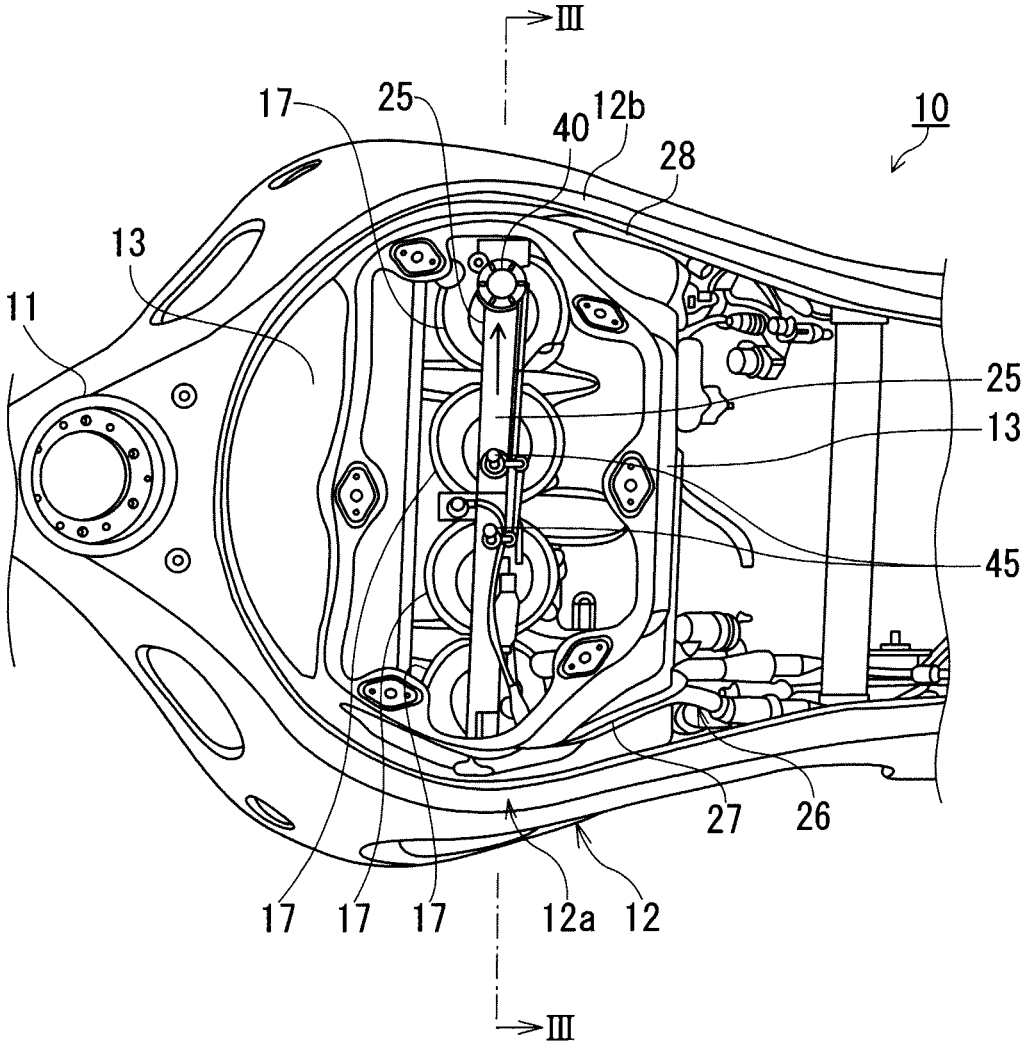
FIG. 2 is a plan view of a vehicle front side shown with a lid of an airbox of a motorcycle being removed.

FIG. 1 is a side view showing an upper front portion of a motorcycle 10 provided with a fuel supply device for an internal combustion engine, and FIG. 2 is a plan view also of the motorcycle.

The motorcycle 10 is provided with, for example, a 4-cylinder 4-cycle engine, not shown, mounted on a vehicle body frame 12.

As shown in FIG. 2, the vehicle body frame 12 includes a pair of left and right main frames 12*a* and 12*b* divided into left and right parts and extending rearward from a head pipe 11, and an airbox 13 functioning as an air cleaner case arranged between the left and right main frames 12*a* and 12*b*. The airbox 13 is arranged above the engine and is provided with an air cleaner, not shown, for cleaning air flown into the airbox 13 from an air inlet.

An air intake system 15 of the engine extends from the airbox 13, and the air intake system 15 communicates with an air inlet of the 4-cycle engine through an air intake passage. An upper opening portion of the airbox 13 is closed by a lid, which is not shown.

[Air Intake System of Internal Combustion Engine]

Figure 3:
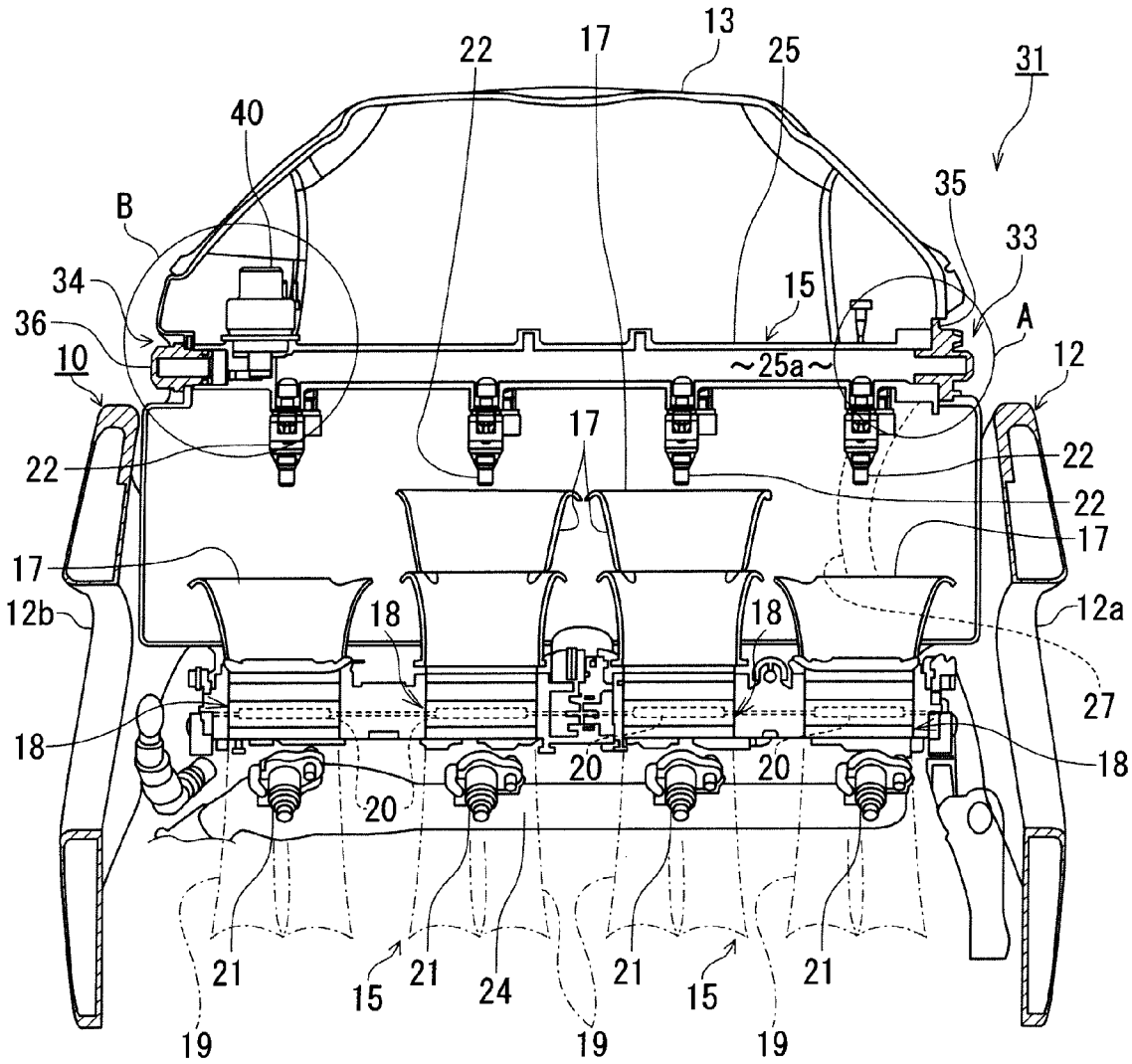
FIG. 3 shows an embodiment of a fuel supply device for an internal combustion engine according to the present invention, and is a sectional view, in the vehicle width direction, taken along the line III-III in FIG. 2.

As shown in FIG. 3, the engine air intake system 15 is connected to an air inlet of a cylinder head of the engine through an air funnel 17 within the airbox 13, and a throttle body 18 and an intake pipe 19 in this order. The airbox 13 is arranged above the throttle body 18, and the air funnel 17 accommodated inside the airbox 13 has an opening gradually widened toward the upstream side to smoothly flow the intake air. The air funnel 17 is provided at the upstream end of the throttle body 18.

A throttle valve 20 is accommodated in the throttle body 18 provided on the way along the engine air intake system 15. The throttle valve 20 is connected to an accelerator grip, which is not shown, and is structured to open or close in conjunction with a throttle operation by the accelerator grip.

A main injector 21 is arranged at the downstream side of the throttle valve 20 as a primary injector, and an auxiliary injector 22 is arranged at the upstream side of the throttle valve 20 as a secondary injector.

The throttle valve 20 provided in the air intake passage of the engine air intake system 15, and the main injector 21 and the auxiliary injector 22 are provided in sets, and one set is arranged for corresponding one cylinder in a 4-cycle engine, and a total of four sets is arranged in a 4-cylinder engine, for example.

[Fuel Supply Unit for Internal Combustion Engine]

Furthermore, fuel within a fuel tank, which is not shown, is supplied to the main injector 21 and the auxiliary injector 22 by operation of a fuel pump via a fuel supply piping 23. The fuel supply piping 23 from the fuel tank is divided on the way along and connected to a delivery pipe (i.e., header pipe) 24 as a fuel supply pipe for distributing the fuel to the main injector 21 and a delivery pipe (i.e., header pipe) 25 as a fuel supply pipe for distributing the fuel to the auxiliary injector 22.

The main injector 21 is attached to the delivery pipe 24 for the distribution to the main injector 21 in a manner of facing each cylinder of the 4-cycle engine at the downstream side of the throttle valve 20. The auxiliary injector 22 is attached to the delivery pipe 25 for the distribution to the auxiliary injector 22, at the upstream side of the throttle valve 20. Supply of fuel to the 4-cycle engine is carried out by injecting fuel inside the delivery pipes 24 and 25 delivered from a fuel pump, not shown, to the air intake passage of the engine air intake system 15 from the main injector 21 and the auxiliary injector 22.

The main injector 21 is provided for the delivery pipe 24 at the downstream side of the throttle body 18, and while the engine is operating, the fuel is continuously injected into the air intake passage of the engine air intake system 15 at the downstream side of the throttle valve 20. On the other hand, the auxiliary injector 22 is provided directly above and facing the entrance of the air funnel 17, and injects fuel, at the upstream side of the throttle valve 20, only at the time of high-output operation of the engine or, depending on the model, only when in a high speed range of above 6,000 to 8,000 rpm or more and about 10,000 rpm, for example.

In the manner mentioned above, the fuel inside the fuel tank is supplied to the main injector 21 and the auxiliary injector 22 by the fuel pump, from the fuel supply piping 23 via the delivery pipes 24 and 25 for distribution, thereby constituting the fuel supply unit 26.

Furthermore, the fuel remaining in the delivery pipe 25 for the auxiliary injector 22 passes through a fuel return pipe 28, joins the surplus fuel from the main injector 21 along the way, and is returned to the fuel tank, not shown, via the fuel return piping 29, thereby constituting the fuel return unit 30 for the surplus fuel. A fuel supply device 31 for an internal combustion engine is thus constructed with the fuel supply unit 26 and the fuel return unit 30 being included.

The delivery pipe 25 for distributing the fuel to the auxiliary injector 22 constituting the fuel supply device 31 for an internal combustion engine has both end portions fixed to a both end support structure supported from the outside by pipe support devices 33 and 34 to a side wall of the airbox 13 as shown in FIG. 3.

Both end portions of the delivery pipe 25 are opened, and plug-shaped adapters 35 and 36 (fuel supply (inlet) side adopter 35 and fuel exhaust (outlet) side adopter 36) as end pieces are provided to the opening end portions. The adapters 35 and 36 seal the both end portions of the delivery pipe 25 in a liquid-tight manner by fuel seals 37 such as O-rings.

Figure 4:
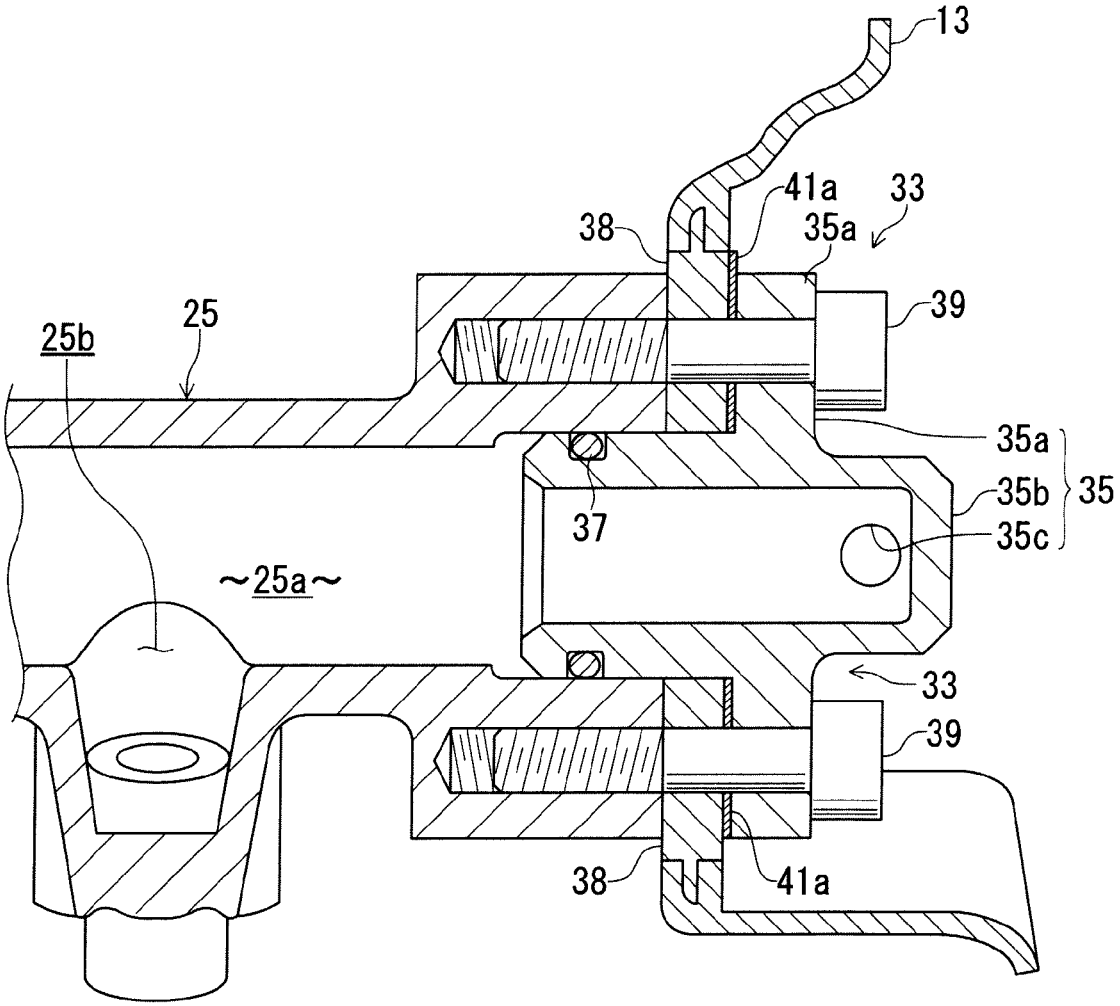
FIG. 4 is a partial enlarged sectional view showing an encircled portion A in FIG. 3 on a fuel supply side.

The pipe support device 33 is mounted from the outside to the fuel supply side of the delivery pipe 25 as shown in FIG. 4. An embedded fixture 38 of the airbox 13 is mounted to the end portion of the delivery pipe 25, a gasket 41*a* is disposed outside, in a facing manner, as a box seal, and the fuel supply side adapter 35 is fixed to a thick end portion of the delivery pipe 25 from the outside of the airbox 13. Specifically, the outer portion or an outer circumferential flange 35*a* of the adapter 35 is fastened to the end portion of the delivery pipe 25 by means of fastening bolt 39 or the like with the embedded fixture 38 and the gasket 41*a* being interposed therebetween. The supply side adapter 35 has a protruding portion 35*b* protruding from the outer circumferential flange 35*a* toward the outer side, and a fuel inlet 35*c* to which a fuel supply pipe 27 is connected opens on the protruding portion 35*b* on the outside of the airbox 13. The fuel supply pipe 27, which is a branched pipe of the fuel supply piping 23, is connected to the fuel inlet 35*c*.

The fuel from the fuel supply pipe 27 is supplied through the fuel inlet 35*c* to an axial direction passage 25*a* in the delivery pipe 25 via a passage inside the adapter 35. The fuel supply pipe 27 is installed, outside the airbox 13, between the airbox 13 and the main frame 12*a* of the vehicle body frame 12.

A plurality of delivery ports 25*b* corresponding to the number of cylinders of the engine are formed to the delivery pipe 25 at predetermined intervals in the axial direction, and the auxiliary injector 22 is provided for each delivery port 25*b*. The auxiliary injector 22 is provided to be adjustable in height position by a spacer 49 (see FIGS. 6 and 7).

Figure 5:
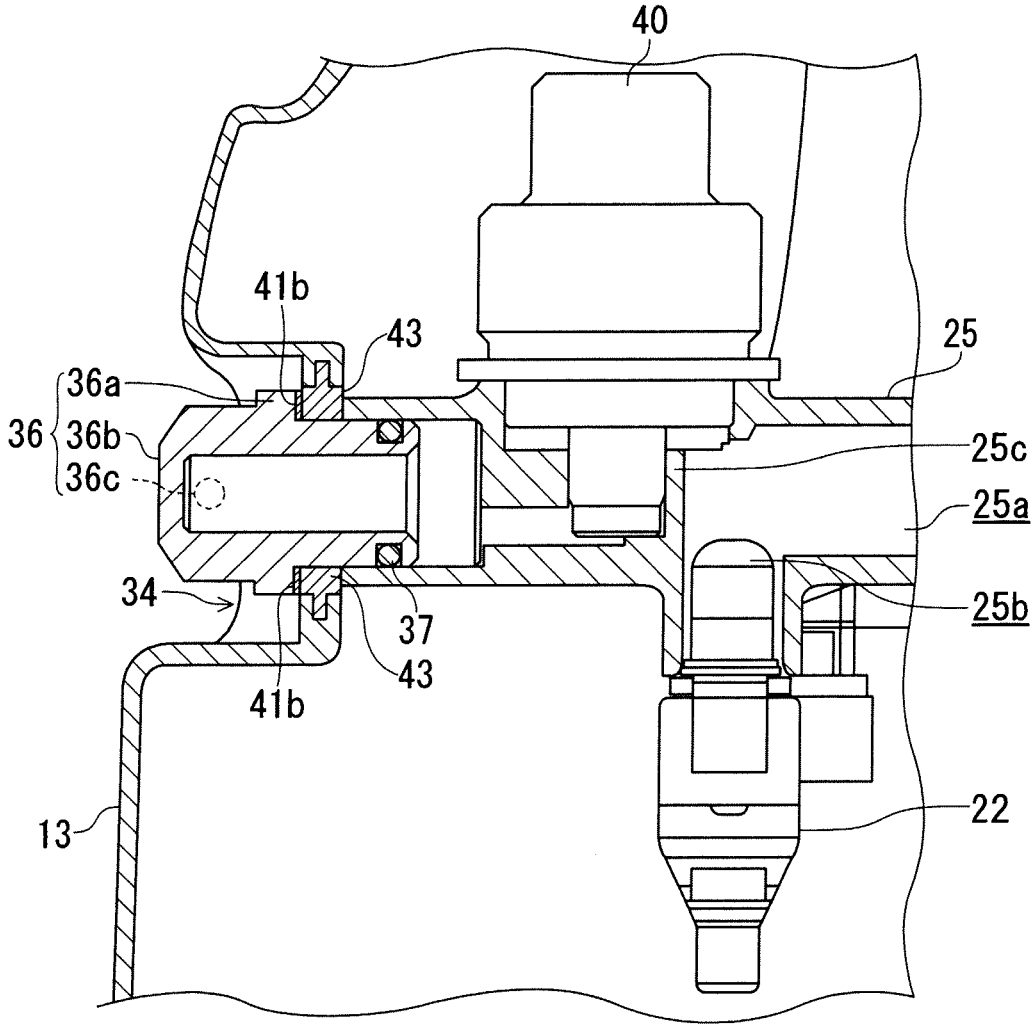
FIG. 5 is a partial enlarged sectional view showing an encircled portion B in FIG. 3 on a surplus fuel return side.

As shown in FIG. 5, a barrier 25*c* is formed to the delivery pipe 25, at the downstream side of the endmost delivery port 25*b*, and a pressure regulator 40 is provided at the downstream of the barrier 25*c*. The pressure regulator 40 adjusts the pressure of fuel to be supplied, and the downstream side of the pressure regulator 40 constitutes the return side of the surplus fuel and an outlet plug-shaped fuel exhaust (outlet) side adapter 36 is mounted from the outside to a return-side pipe end portion. The fuel through the delivery pipe 25 flows as one way flow from the fuel supply side to the return side.

The pipe support device 34 has an end portion on the fuel return side of the delivery pipe 25, as shown in FIG. 5, at which the pipe support device 34 is provided. At the pipe support device 34, a gasket 41*b* is provided on the outside of an embedded fixture 43 of the airbox 13 as a box seal. The embedded fixture 43 and the gasket 41*b* are sandwiched between the end portion of the delivery pipe 25 and the outside or an outer circumferential flange 36*a* of the fuel exhaust (outlet) side adapter 36 by being fastened with a bolt or the like. Like the pipe support device 33 on the fuel supply side of the delivery pipe 25 shown in FIG. 4, the pipe support device 34 is fixed from the outside of the airbox 13.

An outlet 36*c* for the surplus fuel is formed, on the outside of the airbox 13, to a protruding portion 36*b* of the exhaust side adapter 36 constructing the fuel return side end portion, and the outlet 36*c* is connected to the fuel return pipe 28. The surplus fuel flowing out to the return pipe 28 joins the surplus fuel from the main injector 21 side along the way of the flow and is returned to a fuel tank, not shown, through the fuel return piping 29, thereby constituting the fuel return unit 30 for the surplus fuel.

As shown in FIG. 3, the fuel supply device 31 for an internal combustion engine of the present embodiment has the airbox 13 arranged above the throttle body 18 and the main injector 21, and the delivery pipe 25, the auxiliary injector 22 and the air funnel 17 are accommodated in the airbox 13. The air funnel 17 is arranged above the throttle body 18, and the auxiliary injector 22 is arranged above (directly above in the example shown in FIG. 3), the air funnel 17. Each auxiliary injector 22 is attached to the delivery pipe 25.

The delivery pipe 25 is formed of metal material such as aluminum, and extends from one end of the airbox 13 to the other end in the vehicle body width direction. The delivery pipe 25 extends in the left and right direction of the airbox 13, and is attached and fixed to both side walls of the airbox 13. The delivery pipe 25 is attached to a both end support structure for supporting two points by the pipe support devices 33 and 34 from both outsides of the airbox 13, and constitutes a reinforcing material for the airbox 13.

Since the delivery pipe 25 is fixed and supported at the left and right side walls of the airbox 13 on both sides of the vehicle body in the width direction, there is no need for a strut or a strut bracket for the delivery pipe 25 in the airbox 13, and it is not necessary to locate a pipe support structure.

Accordingly, the structure or arrangement inside the airbox 13 is simplified, and the intake air resistance can be reduced and the flow of the intake air can be made smooth without sacrificing the airbox capacity and the flow of intake air in the airbox 13.

Furthermore, the delivery pipe 25 is supported at both sides thereof by a two-point support structure by the pipe support devices 33 and 34 from both outsides of the airbox 13. The delivery pipe 25 is fixed to both side walls of the airbox 13, connects the left and right of the airbox 13 and reinforces the airbox 13. In this manner, the delivery pipe 25 functions as a reinforcing member for the resin airbox 13, increases the physical and mechanical strengths of the airbox 13 and can maintain the rigidity of the airbox.

Furthermore, as shown in FIGS. 1 and 3, when the delivery pipe 25 is mounted on a vehicle, the delivery pipe 25 is arranged so as to be positioned higher than the vehicle body frame 12 and is attached from the outside while being supported on both ends by the pipe support devices 33 and 34, and accordingly, the delivery pipe 25 can be removed from the airbox 13 in a state of the airbox 13 being mounted on the motorcycle. By arranging the delivery pipe 25 at a position higher than the vehicle body frame 12, the height of the auxiliary injector 22 is allowed to be freely set, and the degree of freedom of setting of the auxiliary injector 22 is increased.

Furthermore, the delivery pipe 25 extends in the left and right direction in the airbox 13 and traverses in the vehicle width direction, and is fixed to the left and right side walls of the airbox 13, thereby simplifying the inside, particularly, the periphery or above the delivery pipe 25, of the airbox 13, and reducing the intake air resistance can be expected. Accordingly, the intake air which has flowed into the airbox 13 can be smoothly led to the air funnel 17 below the delivery pipe 25.

As described above, the delivery pipe 25 supported on both ends of the airbox 13 can eliminate the provision of the pipe support member, and the airbox capacity can be increased without making the airbox 13 larger. In addition, the intake air which has flowed into the airbox 13 can be smoothly led to the air funnel 17 while suppressing the influence of pulsation and reducing the intake air resistance, and the engine output can be expected to increase in the entire range.

Furthermore, since it is not necessary for the airbox 13 to provide a support structure for the delivery pipe 25 inside the box, and it is also not necessary to provide any support structure above the delivery pipe 25, the flow of intake air which has flowed into the airbox 13 is not disturbed. Therefore, the air flow capacity can be maintained above the delivery pipe 25 and equally in front and back of the air funnel 17. The flow of intake air which has flowed into the airbox 13 is thus made smooth and the influence of intake air pulsation is suppressed, and the amount of intake air in the airbox 13 can be increased.

Accordingly, there can be provided a fuel supply device for an internal combustion engine capable of smoothly and swiftly suppressing an extreme increase in the amount of intake air and responding linearly to a throttle operation.

[Fuel Supply Device for Internal Combustion Engine]

A fuel supply unit used in the fuel supply device for an internal combustion engine will be described hereunder with reference to FIGS. 6 to 8.

Figure 6:
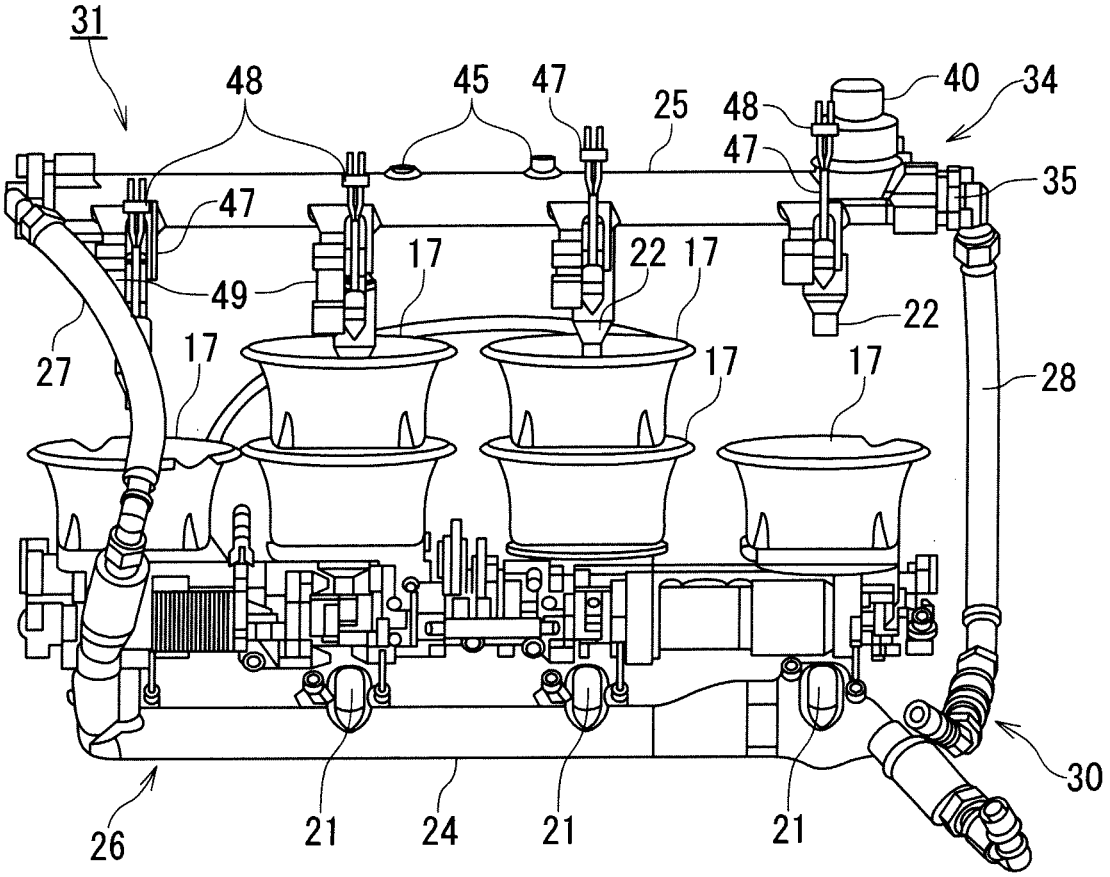
FIG. 6 is view showing an embodiment of the fuel supply device for an internal combustion engine according to the present embodiment as viewed diagonally from the rear side of the vehicle.
Figure 7:
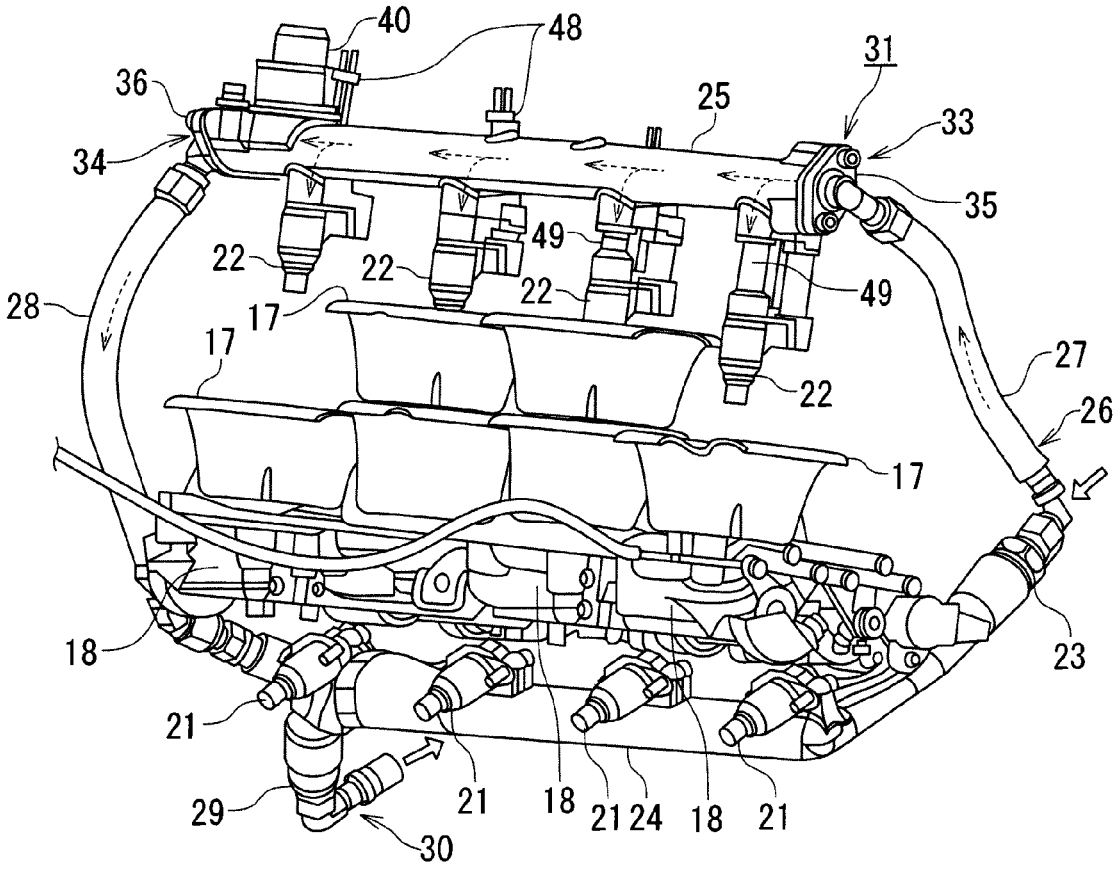
FIG. 7 is a view showing an embodiment of the fuel supply device for an internal combustion engine according to the present embodiment as viewed diagonally from the front side of the vehicle.
Figure 8:
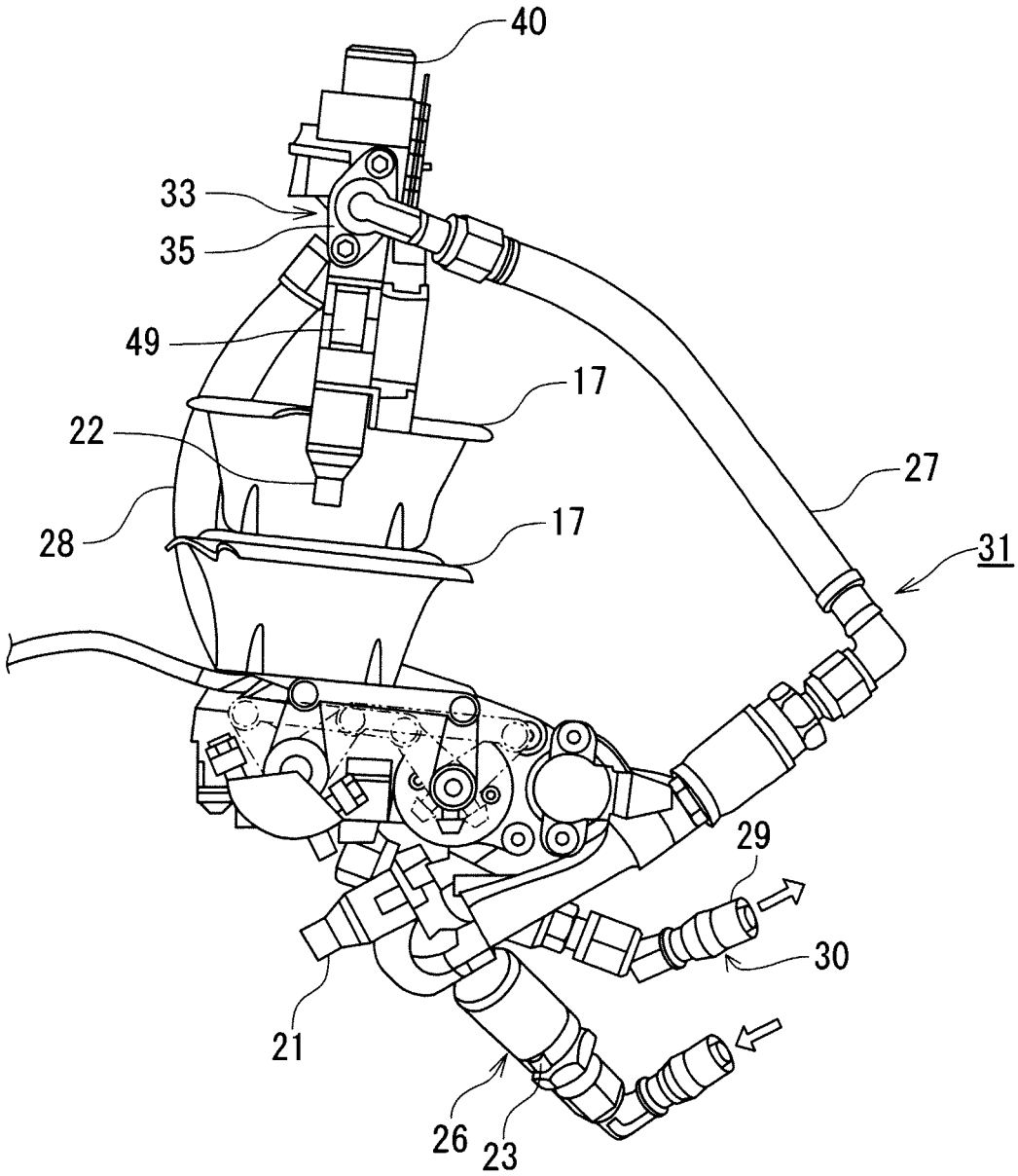
FIG. 8 is a left side view showing an embodiment of the fuel supply device for an internal combustion engine according to the present invention.

FIGS. 6 to 8 are views from which the airbox 13 is omitted. The fuel supply device 31 for an internal combustion engine includes the fuel supply unit 26 for supplying fuel inside a fuel tank, not shown, to the main injector 21 and the auxiliary injector 22 by a fuel pump through the fuel supply piping 23, and the fuel return unit 30 for returning the surplus fuel to the fuel tank through the fuel return piping 29. The fuel supply unit 26 supplies the fuel from the fuel supply piping 23 to the main injector 21 at the downstream side of the throttle valve 20 through the delivery pipe 24, and when the engine is operating, the fuel is continuously injected from the main injector 21 to the air intake passage.

Further, the fuel supply unit 26 includes the fuel supply pipe 27 branched from the fuel supply piping 23 of the main injector 21, and the fuel supply pipe 27 is connected, on the outside the airbox 13, to the delivery pipe 25 from a portion between the lateral outer side of the airbox 13 and the vehicle body frame 12. Specifically, the fuel supply pipe 27, which is a branched pipe for the fuel supply piping 23, is connected, on the outside of the airbox 13, to the inlet of the supply side adapter 35 provided on the fuel supply side of the delivery pipe 25.

The fuel supplied from the fuel supply pipe 27 is led, on the outside of the airbox 13, from the fuel supply side adapter 35 to the delivery pipe 25, passes through each delivery port 25*b* provided to the delivery pipe 25, and is supplied to each auxiliary injector 22. Then, the fuel is injected from the auxiliary injector 22, from the upper side of the air funnel 17, toward the funnel opening, only at the time of high-speed operation of the engine.

At this time, the delivery pipe 25 is arranged above each air funnel 17 in the axial direction so as to overlap with the funnel opening portion in the plan view shown in FIG. 2.

Since it is required for the auxiliary injector 22 attached to the delivery pipe 25 to inject the fuel toward the center of the air funnel 17, it is arranged above the air funnel 17 in the extending direction such that the fuel passes through the funnel opening portion.

In other words, the auxiliary injector 22 is arranged below the delivery pipe 25 and in the extending direction of the air funnel 17 so as to overlap with the delivery pipe 25 in the plan view shown in FIG. 2. Therefore, the sizes of the projection area of the delivery pipe 25 and the auxiliary injector 22 in the center axial direction of the air funnel 17 can be minimally maintained, and the resistance of the intake air flowing into the airbox 13 can be reduced.

Moreover, the delivery pipe 25 is provided with sensors 45 and 45 such as a pressure sensor and a temperature sensor for detecting the state of the fuel, and the fuel pressure regulator 40. The sensors 45 and 45 and the fuel pressure regulator 40 are arranged so as to overlap with the delivery pipe 25 in the extending direction of the air funnel 17 in the plan view shown in FIG. 2. By arranging the sensors 45 and 45 for fuel pressure and fuel temperature, and the fuel pressure regulator 40 in the vertical direction of the air funnel 17 above or below the delivery pipe 25 so as to overlap with the delivery pipe 25, it becomes possible to make small the sizes of projection area in the direction of the flow of intake air flowing into the airbox 13 and to effectively reduce the intake air resistance.

Furthermore, as shown in FIG. 2, a harness 46 such as a cable connected to the auxiliary injector 22, the sensors 45 and 45, and the fuel pressure regulator 40 is arranged along the delivery pipe 25. According to such routing arrangement of the harness 46 connected to the auxiliary injector 22 and the sensors 45 along the delivery pipe 25, it also becomes possible to make small the size of projection area in the direction of the flow of intake air and to effectively reduce the intake air resistance.

In addition to the routing arrangement of the harness 46 to the delivery pipe 25, a harness 47 and a connector 48 connected to the auxiliary injector 22 are routed along the axial direction of the air funnel 17, and the size of projection area required for such routing arrangement can be reduced. The size of projection area directing from above to below along the axial direction of the air funnel 17 can be made as small as possible.

As described, by wiring the harnesses 46 and 47, and the connector 48 in parallel with and at the downstream side of the delivery pipe 25, the size of projection area, directing from above to below the air funnel 17, can be made as small as possible, and the intake air led inside the airbox 13 can be led smoothly to the funnel opening of the air funnel 17 while making the intake air resistance as small as possible.

On the other hand, the auxiliary injector 22 injects the fuel at the time of high-output operation of the engine in the high-speed range, and the fuel left over in the fuel injection by the auxiliary injector 22 is led to the return side of the delivery pipe 25, and is then led outside the airbox 13 to the fuel return pipe 28. The surplus fuel led to the fuel return pipe 28 joins the surplus fuel from the main injector 21, passes through the fuel return piping 29, and is then returned to a fuel tank, not shown.

At this time, the fuel is supplied to the delivery pipe 25 from the outside of the side wall on the supply side of the airbox 13, and the surplus fuel is led from the delivery pipe 25 to the fuel return pipe 28 on the outside of the side wall on the return side of the airbox 13. Accordingly, the fuel is supplied from the outside of the side wall on the supply side of the airbox 13 and is led to the fuel return pipe 28 outside the other side wall, and the flow of fuel flowing through the delivery pipe 25 can be made one way flow.

As mentioned, by making the flow through the delivery pipe 25 one way flow from the fuel supply side to the surplus fuel return side, the structure inside the airbox 13 can be made simple and compact. In addition, since the flow of fuel inside the delivery pipe 25 is one way flow, and the delivery pipe 25 can be provided to the airbox 13 at a position higher than the vehicle body frame 12 as shown in FIGS. 1 and 3, the delivery pipe 25 can be made longer than the vehicle width between the left and right main frames 12*a* and 12*b* of the vehicle body frame 12. Furthermore, since the delivery pipe 25 provided to the airbox 13 is positioned higher than the vehicle body frame 12, the delivery pipe 25 can be made detachable by using the pipe support devices 33 and 34 attached, from the outside, to the airbox 13 in a state of being mounted to the vehicle body.

Still furthermore, the height of the injector can be freely set in the airbox 13, as shown in FIGS. 6 to 8 by additionally providing the spacer 49 to the auxiliary injector 22 provided to the delivery pipe 25. In addition, by simply opening the lid of the airbox 13 mounted on the vehicle, the auxiliary injector 22 can be supported and the height of the auxiliary injector 22 corresponding to the engine cylinder can be optionally adjusted, thereby providing an appropriate supporting structure for the auxiliary injector 22.

It is further to be noted that the present invention is not limited to the described embodiment and many other changes and modifications or alternations may be applicable without departing from the spirits and scopes of the appended claims.

For example, in the above description of the embodiment of the present invention, although there is explained an example in which the fuel supply device for an internal combustion engine is applied to a motorcycle, the fuel supply device for an internal combustion engine of the present embodiment can be applied to a four-wheeled vehicle and specialized equipment such as a jet ski, an outboard motor, a lawn mower and the like, as long as they are equipped with a 4-cycle engine.

Furthermore, in the described embodiment, there is explained an example in which the delivery pipe is extended in the vehicle width direction of the airbox and is supported at both ends by being attached from the outside of the airbox using pipe support devices. However, it may be also possible to fix a fuel distribution delivery pipe serving both as a fuel supply piping and as a fixing strut to the airbox in a two-point support manner by extending the pipe in various directions such as the longitudinal direction or diagonal direction, with respect to the vehicle, of the airbox.

What is claimed is:

1. A fuel supply device for an internal combustion engine including a throttle valve and an airbox, the device comprising:

a main injector disposed at a downstream side of the throttle valve;

an auxiliary injector disposed at an upstream side of the throttle valve and in the airbox; and a delivery pipe disposed inside the airbox having an upper opening that is closed by a lid cover, and adopted to supply and distribute a fuel to the auxiliary injector, wherein the delivery pipe has an end portion which is supported on a side wall of the air box by a pipe support device that is provided with a fuel supply side adapter closing an end portion on a fuel supply side of the delivery pipe, and a fuel supply piping is connected to a fuel inlet opened to an outside of the airbox to the fuel supply side adapter.

2. The fuel supply device according to claim 1, wherein the delivery pipe is mounted to both side walls of the airbox from lateral outer sides of the airbox by a pipe support device.

3. The fuel supply device according to claim 2, wherein the pipe support device includes an fuel exhaust side adapter closing an end portion on a fuel return side of the delivery pipe from an outside of another one of the side walls, and a fuel return piping is connected to a fuel outlet opened to an outside of the airbox to the fuel exhaust side adapter.

4. The fuel supply device according to claim 1, wherein the delivery pipe is arranged above a vehicle body frame.

5. The fuel supply device according to claim 1, wherein the delivery pipe is disposed so as to be overlapped, in a plan view, with an opening portion of an air funnel in an extending direction of the air funnel provided inside the airbox.

6. The fuel supply device according to claim 1, wherein the auxiliary injector is arranged under the delivery pipe in an extending direction of an air funnel provided inside the airbox so as to be overlapped with the delivery pipe in a plan view.

7. The fuel supply device according to claim 1, wherein the delivery pipe is mounted with a sensor for detecting a state of fuel and a fuel pressure regulator for adjusting a pressure of fuel, and the sensor and the fuel pressure regulator are arranged in the extending direction of an air funnel provided inside the air box in a plan view so as to be overlapped with the delivery pipe.

8. The fuel supply device according to claim 7, wherein a harness connected to the auxiliary injector and the sensor is arranged along the delivery pipe.

* * * * *